US011510484B2

(12) United States Patent
Hobbs et al.

(10) Patent No.: US 11,510,484 B2
(45) Date of Patent: Nov. 29, 2022

(54) TOOTHPASTE DISPENSING BRUSH AND SYSTEM

(71) Applicants: Willie Frank Hobbs, Butler, PA (US); Henry William Ferguson, Martinez, GA (US)

(72) Inventors: Willie Frank Hobbs, Butler, PA (US); Henry William Ferguson, Martinez, GA (US)

( * ) Notice: Subject to any disclaimer, the term of this patent is extended or adjusted under 35 U.S.C. 154(b) by 0 days.

(21) Appl. No.: 15/980,065

(22) Filed: May 15, 2018

(65) Prior Publication Data

US 2019/0133309 A1 May 9, 2019

Related U.S. Application Data

(60) Provisional application No. 62/521,509, filed on Jun. 18, 2017, provisional application No. 62/557,564, filed on Sep. 12, 2017.

(51) Int. Cl.

| | |
|---|---|
| ***A46B 11/04*** | (2006.01) |
| ***A46B 11/00*** | (2006.01) |
| ***A46B 9/04*** | (2006.01) |

(52) U.S. Cl.

CPC ..... *A46B 11/0031* (2013.01); *A46B 9/04* (2013.01); *A46B 11/0062* (2013.01); *A46B 11/0086* (2013.01); *A46B 2200/1066* (2013.01)

(58) Field of Classification Search

CPC ..... A46B 11/002; A46B 11/0024; A46B 11/0027; A46B 2200/1066; A46B 15/0028; A61C 17/024

USPC ..... 401/286

See application file for complete search history.

(56) References Cited

U.S. PATENT DOCUMENTS

| | | | | |
|---|---|---|---|---|
| 9,462,873 | B2 * | 10/2016 | Casasanta, III | A46B 13/023 |
| 2006/0222451 | A1 * | 10/2006 | Glassman | A46B 11/0027 401/270 |
| 2020/0188075 | A1 * | 6/2020 | Speicher | A61C 17/221 |

* cited by examiner

*Primary Examiner* — Jennifer C Chiang

(74) *Attorney, Agent, or Firm* — Frost Brown Todd LLC

(57) ABSTRACT

A toothpaste dispensing toothbrush having a motorized based that provides one-handed use and an audible measuring device are described herein.

9 Claims, 10 Drawing Sheets

TOOTHPASTE DISPENSING BRUSH AND SYSTEM

CROSS-REFERENCE TO RELATED APPLICATIONS

This application claims priority from U.S. Provisional No. 62/521,509 entitled "TOOTHBRUSH" filed Jun. 18, 2017 and U.S. Provisional No. 62/557,564 entitled "MOTORIZED BASE" filed Sep. 12, 2017, the entire contents of each of which are hereby incorporated by reference in their entireties.

GOVERNMENT INTERESTS

Not applicable

PARTIES TO A JOINT RESEARCH AGREEMENT

Not applicable

INCORPORATION OF MATERIAL ON COMPACT DISC

Not applicable

BACKGROUND

Not applicable

SUMMARY OF THE INVENTION

Embodiments of the invention include a system having a toothbrush and a motorized base, the motorized base having a lower stabilization housing, housing a motor or actuator operably coupled to an upper receiver housing configured to receive the toothbrush, the receiver housing having a receiver holder having an upper and lower surface and upward extending sides containing the series of ridges configured to associate with grooves on the toothbrush and cause a portion of the toothbrush to rotate when the motor or actuator is engaged, the receiver holder being in communication with a receiver base having a flat upper surface and a lower surface, the lower surface comprising an engagement pin that traverses the receiver holder through a hole through and a series of springs seated on the upper surface of the receiver holder, the engagement pin operably engages gearing operably attached to the motor or actuator attached to the lower side of the receiver holder such that the springs of the movable receiving base are compressed when the toothbrush is pressed into the upper receiver housing causing the engagement pin to engage the gearing and activating a motor or actuator causing the receiver holder to rotate, the motorized base having an audible measuring device that clicks or beeps as the receiver holder rotates.

In some embodiments, the audible measuring device may include a speaker or clicker, capable of producing sound at regular intervals when the movable receiving base is engaged against the receiver holder. In certain embodiments, a sound may be produced for every ¼ turn of the receiver holder.

In some embodiments, the toothbrush may include a toothbrush handle having upper drainage grooves on an upper surface of the toothbrush handle and lower drainage grooves on a lower surface of the toothbrush handle. In particular embodiments, the upper drainage grooves and the lower drainage grooves may be composed of the same material as the toothbrush handle, and in other embodiments, the upper drainage grooves and lower drainage grooves may be composed of a different material than the toothbrush handle. In some embodiments, the upper drainage grooves and lower drainage grooves may be composed of a material having anti-bacterial properties or having an antibiotic dispersed within the material. In certain embodiments, the upper drainage grooves and lower drainage grooves may be integral with the toothbrush handle, and in some embodiments, the upper drainage grooves and lower drainage grooves may be a separate component from the toothbrush handle and are replaceable.

Other embodiments are directed to a toothbrush having a toothbrush head and a toothbrush handle. In some embodiments, the toothbrush may include a toothbrush handle having upper drainage grooves on an upper surface of the toothbrush handle and lower drainage grooves on a lower surface of the toothbrush handle. In particular embodiments, the upper drainage grooves and the lower drainage grooves may be composed of the same material as the toothbrush handle, and in other embodiments, the upper drainage grooves and lower drainage grooves may be composed of a different material than the toothbrush handle. In some embodiments, the upper drainage grooves and lower drainage grooves may be composed of a material having anti-bacterial properties or having an antibiotic dispersed within the material. In certain embodiments, the upper drainage grooves and lower drainage grooves may be integral with the toothbrush handle, and in some embodiments, the upper drainage grooves and lower drainage grooves may be a separate component from the toothbrush handle and are replaceable. In particular embodiments, the toothbrush head may be integral to the toothbrush, and in some embodiments, the toothbrush head may be removable from the toothbrush handle.

DESCRIPTION OF THE DRAWINGS

Examples of the specific embodiments are illustrated in the accompanying drawings. While the invention will be described in conjunction with these specific embodiments, it will be understood that it is not intended to limit the invention to such specific embodiments. On the contrary, it is intended to cover alternatives, modifications, and equivalents as may be included within the spirit and scope of the invention. In the following description, numerous specific details are set forth in order to provide a thorough understanding of the present invention. The present invention may be practiced without some or all of these specific details. In other instances, well known process operations have not been described in details so as to not unnecessarily obscure the present invention.

DETAILED DESCRIPTION

Figure 1A:
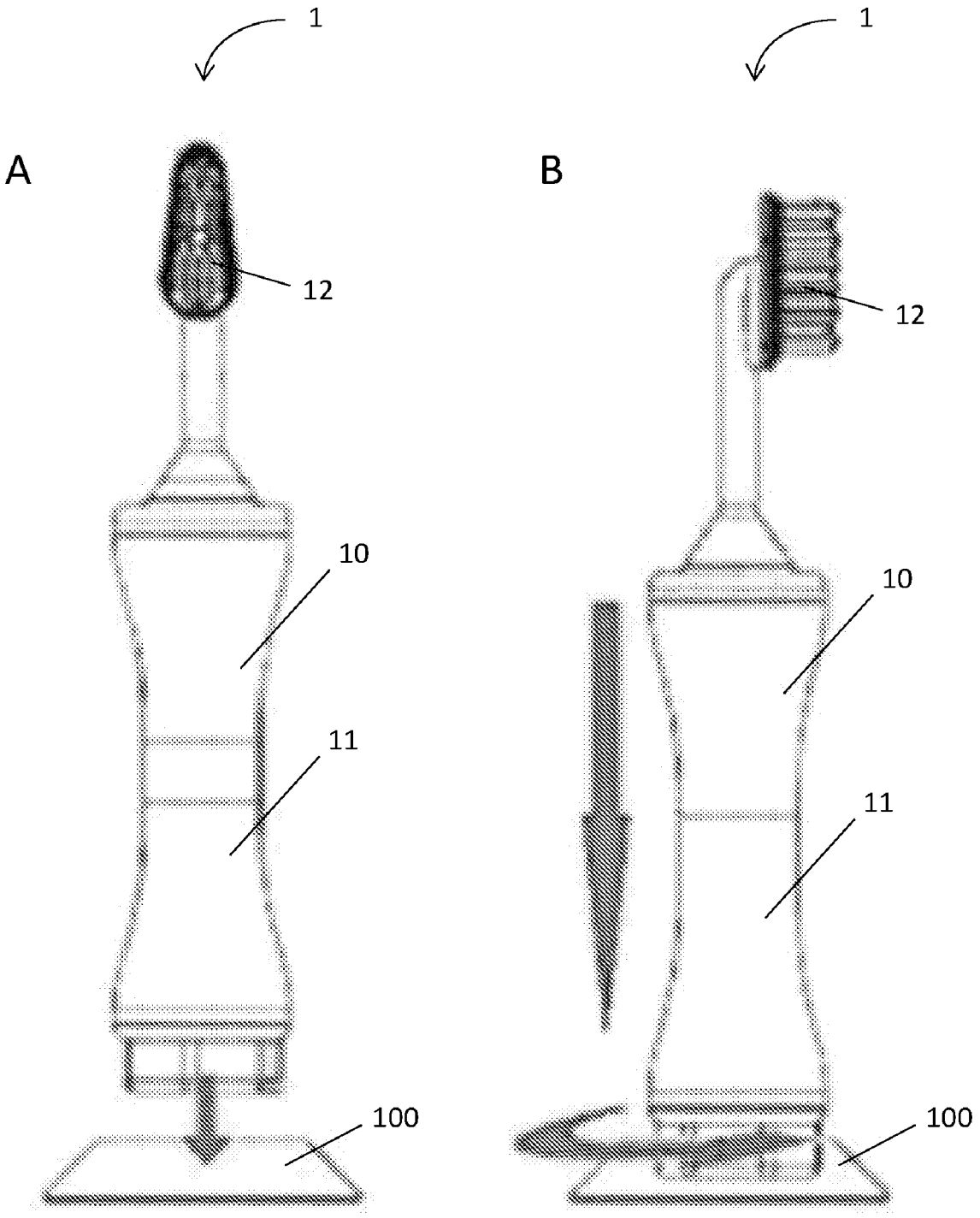
FIG. 1A is an illustration of the toothbrush and motorized base of embodiments. Panel A shows a front view of the toothbrush and Panel B shows a side view of the toothbrush being received by the motorized base.

Various aspects now will be described more fully hereinafter. Such aspects may, however, be embodied in many different forms and should not be construed as limited to the embodiments set forth herein; rather, these embodiments are provided so that this disclosure will be thorough and complete, and will fully convey its scope to those skilled in the art.

Where a range of values is provided, it is intended that each intervening value between the upper and lower limit of that range and any other stated or intervening value in that stated range is encompassed within the disclosure. For example, if a range of 1 μm to 8 μm is stated, 2 μm, 3 μm, 4 μm, 5 μm, 6 μm, and 7 μm are also intended to be explicitly disclosed, as well as the range of values greater than or equal to 1 μm and the range of values less than or equal to 8 μm.

All percentages, parts and ratios are based upon the total weight of the topical compositions and all measurements made are at about 25° C., unless otherwise specified.

The singular forms "a," "an," and "the" include plural referents unless the context clearly dictates otherwise. Thus, for example, reference to a "polymer" includes a single polymer as well as two or more of the same or different polymers; reference to an "excipient" includes a single excipient as well as two or more of the same or different excipients, and the like.

The word "about" when immediately preceding a numerical value means a range of plus or minus 10% of that value, e.g, "about 50" means 45 to 55, "about 25,000" means 22,500 to 27,500, etc, unless the context of the disclosure indicates otherwise, or is inconsistent with such an interpretation. For example, in a list of numerical values such as "about 49, about 50, about 55, "about 50" means a range extending to less than half the interval(s) between the preceding and subsequent values, e.g, more than 49.5 to less than 52.5. Furthermore, the phrases "less than about" a value or "greater than about" a value should be understood in view of the definition of the term "about" provided herein.

By hereby reserving the right to proviso out or exclude any individual members of any such group, including any sub-ranges or combinations of sub-ranges within the group, that can be claimed according to a range or in any similar manner, less than the full measure of this disclosure can be claimed for any reason. Further, by hereby reserving the right to proviso out or exclude any individual substituents, analogs, compounds, ligands, structures, or groups thereof, or any members of a claimed group, less than the full measure of this disclosure can be claimed for any reason. Throughout this disclosure, various patents, patent applications and publications are referenced. The disclosures of these patents, patent applications and publications in their entireties are incorporated into this disclosure by reference in order to more fully describe the state of the art as known to those skilled therein as of the date of this disclosure. This disclosure will govern in the instance that there is any inconsistency between the patents, patent applications and publications cited and this disclosure.

For convenience, certain terms employed in the specification, examples and claims are collected here. Unless defined otherwise, all technical and scientific terms used in this disclosure have the same meanings as commonly understood by one of ordinary skill in the art to which this disclosure belongs.

Figure 1B:
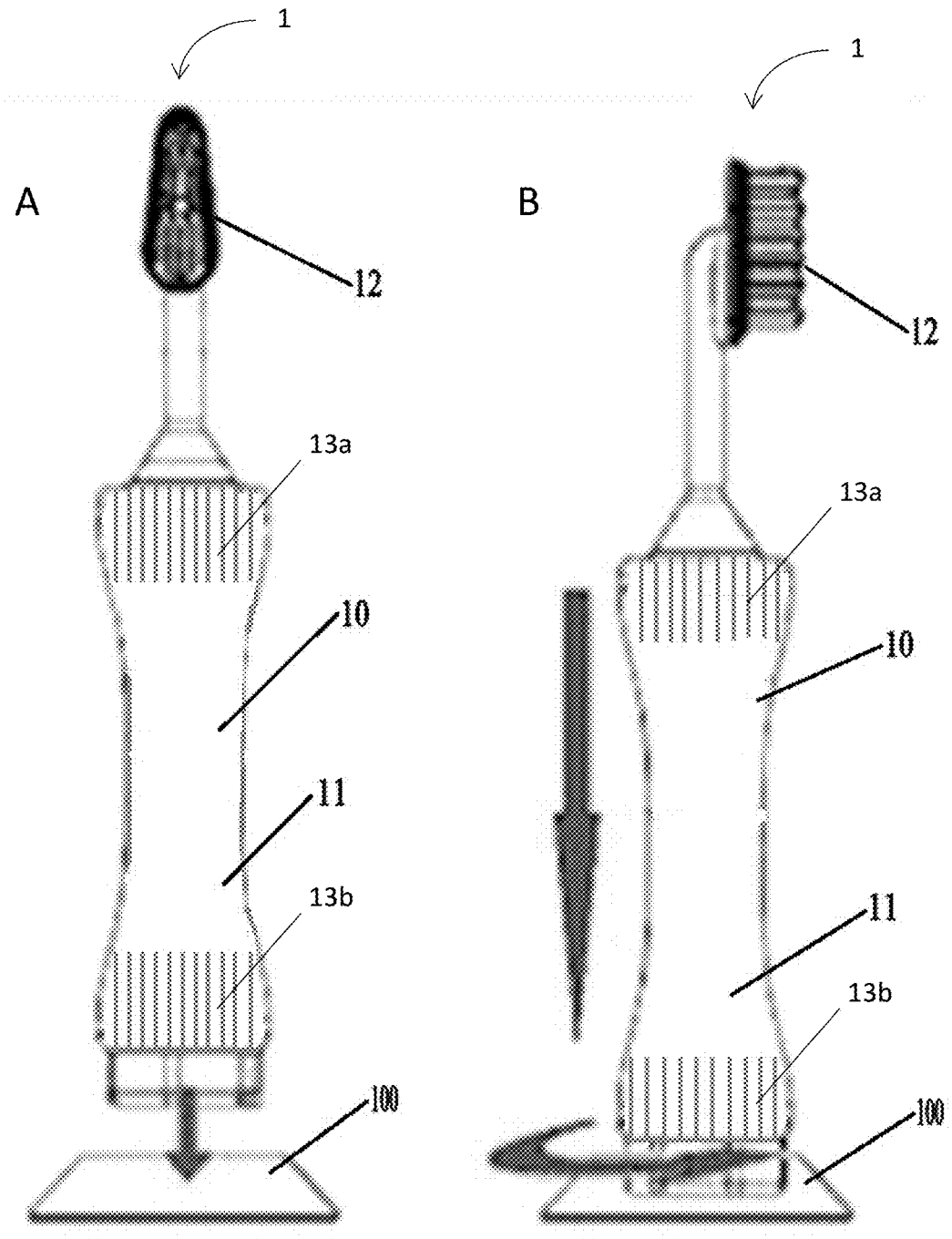
FIG. 1B is an illustration of the toothbrush having upper and lower drainage grooves and motorized base of embodiments. Panel A shows a front view of the toothbrush and Panel B shows a side view of the toothbrush being received by the motorized base.

Embodiments of the invention are directed to a system for applying toothpaste to a toothbrush. FIG. 1A, 1B shows a system 1 of the invention including a toothbrush 10 and a motorized base 100. As illustrated in FIG. 1A, 1B, the toothbrush 10 of the system may is received by the motorized base 100, upon which a motor or actuator in the base is activated causing a portion of the base to rotate pushing toothpaste held within reservoir in the toothbrush handle 11 out of the reservoir and onto the brush head 12. The motorized base 100 allows for single handed use, and in certain embodiments, the motorized base 100 may include an audible measuring device that, for example, clicks or beeps as toothpaste is dispensed. Using audible measuring, visually impaired persons can be notified based on audible measuring that sufficient toothpaste has been applied to the toothbrush head 12 without overapplying.

FIG. 1B illustrates an embodiment of the invention including upper drainage grooves 13*a* on an upper surface of the toothbrush handle and lower drainage grooves 13*b* on a lower surface of the toothbrush handle. The upper drainage grooves 13*a* and lower drainage grooves 13*b* allow water and substances within water including for example bacteria to be carried away from the toothbrush head 12 and toothbrush handle 11. In some embodiments, the upper drainage grooves 13*a* and lower drainage grooves 13*b* may be composed of the same material as the toothbrush handle 11. In other embodiments, the upper drainage grooves 13*a* and lower drainage grooves 13*b* may be composed of a different material than the toothbrush handle 11, and in particular embodiments, the upper drainage grooves 13*a* and lower drainage grooves 13*b* may be composed of a material having anti-bacterial properties or having an antibiotic dispersed within the material. The upper drainage grooves 13*a* and lower drainage grooves 13*b* may be integral with the toothbrush handle 11, and in some embodiments, the upper drainage grooves 13*a* and lower drainage grooves 13*b* may be a separate component from the toothbrush handle 11. Thus, the upper drainage grooves 13*a* and lower drainage grooves 13*b* may be replaceable to provide easy cleaning and improved anti-bacterial activity.

Figure 2:
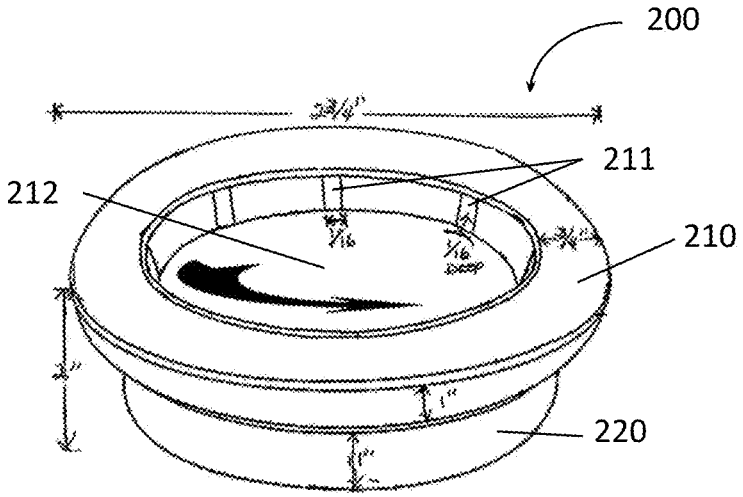
FIG. 2 is an illustration of an external view of the motorized base.
Figure 3:
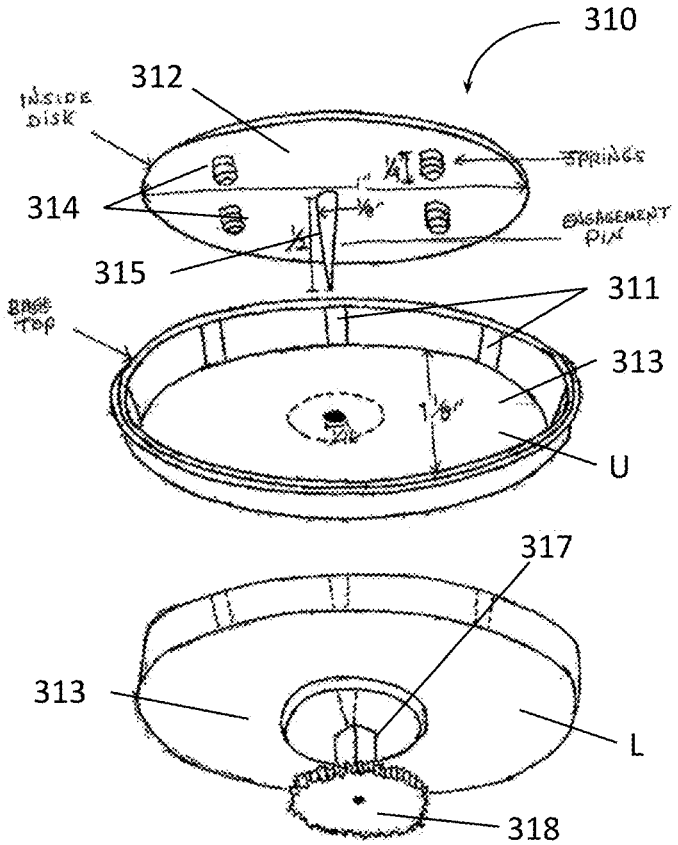
FIG. 3 is a diagram illustrating the components of the upper receiver housing.

FIG. 2-5 illustrate a motorized based 200 of various embodiments of the invention. FIG. 2 shows an external view of the motorized base 200, which includes an upper receiver 210 housing and a lower stabilization housing 220. The upper receiver housing 210 may be composed of two or more parts and may at least include a receiving base 212 and a series of ridges 211 positioned to operably engage grooves in the base of the toothbrush (not pictured). In some embodiments as illustrated in FIG. 3, the upper receiver housing 310 having an outer surface and an inner surface and including a movable receiving base 312 having a series of springs 314 on the lower surface. The movable receiving base 312 may be received by a receiver holder 313 having a flat upper surface U configured to receive an engagement pin 315 attached to the movable receiving base provide a surface on which the springs 314 may be seated. The receiver holder 313 may further include upward extending side containing the series of ridges 311. The engagement pin 315 may traverse the receiver holder 313 and operably engage a sleeve 317 and gearing 318 attached to the lower L side of the receiver holder 313. When engaged by pressing the toothbrush against the movable receiving base 312, the springs 314 are compressed allowing the engagement pin 315 to engage the sleeve 317 and gearing 318 activating a motor that causes the receiver holder 313 and receiver base 312 to rotate. The series of ridges 311 associated with grooves on the toothbrush may cause the toothbrush to dispense toothpaste from a reservoir in the toothbrush body.

Figure 4:
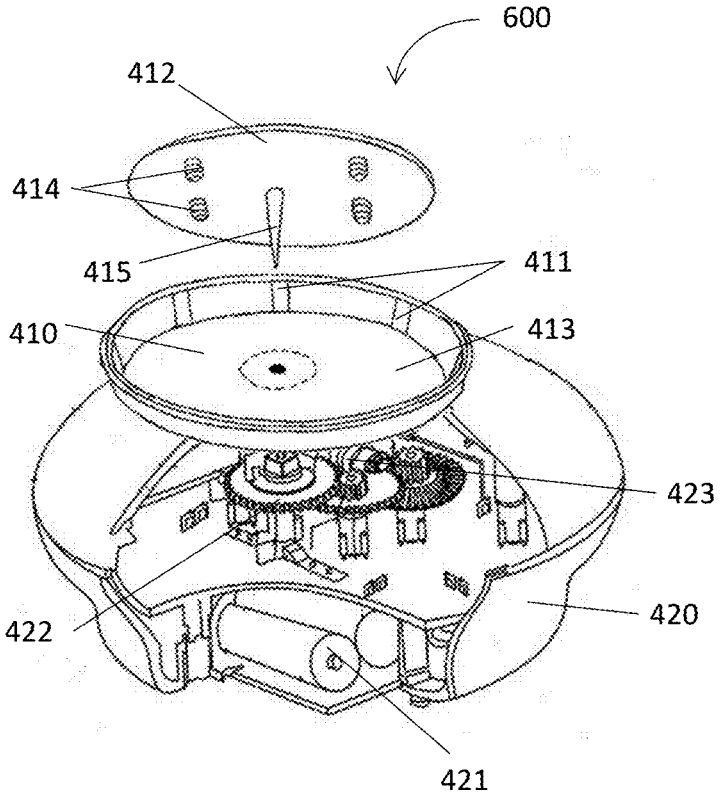
FIG. 4 is a diagram illustrating the components of the upper receiver housing engaging the lower stabilization housing and the motor or actuator and gearing housed in the lower stabilization housing.
Figure 5:
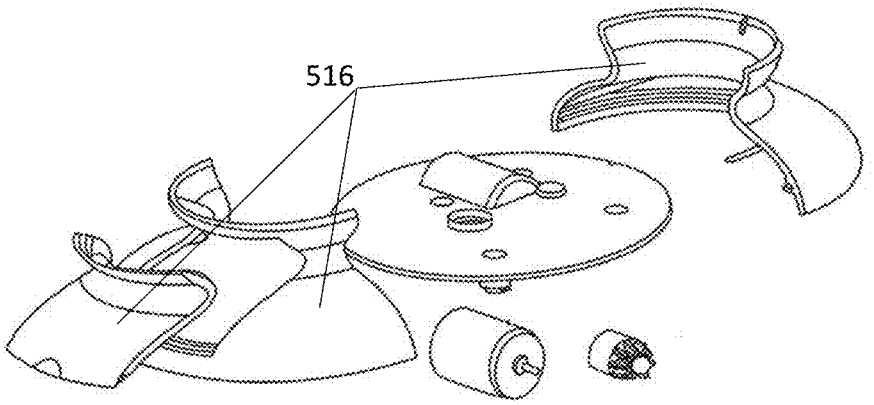
FIG. 5 is a diagram illustrating components of the lower stabilization housing.

FIG. 4 illustrates the motorized base 400, which includes an upper receiver 410 housing and a lower stabilization housing 420. The upper receiver 410 includes a movable receiving base 412 received by a receiver holder 413 having a flat upper surface configured to receive an engagement pin 415 attached to the movable receiving base 412 provide a surface on which the springs 414 may be seated. The receiver holder 413 may further include upward extending side containing the series of ridges 411. The engagement pin 415 may traverse the receiver holder 413 and operably engage a sleeve and gearing attached to the lower side of the receiver holder 413 (not pictured). The lower stabilization base 420 includes additional gearing 422 positioned to operably connect a motor 423 to the gearing attached to the lower side of the receiver holder 413. The lower stabilization base 420 may further include a housing for batteries 421 and a housing covering the various components of the lower stabilization base. FIG. 5 illustrates various components of a housing 516 for covering the upper receiver includes a movable receiving base received by a receiver holder.

In various embodiments, the motorized base 400 may include a speaker or other means for producing sound, such as a clicker, as the toothpaste is dispensed onto the toothbrush. Sound can be produced at regular intervals beginning when the movable receiving base 412 is depressed against the receiver holder 413 and ending when the movable base 412 is released, thereby providing a non-visual means for determining the amount of toothpaste applied to the toothbrush. In other embodiments, sound may be produced as the receiver holder 413 is rotated. For example, a sound may be produced for every ¼ turn of the receiver holder 413, thereby providing another non-visual means for determining the amount of toothpaste applied to the toothbrush. Such audible signals may provide a non-visual, non-tactile means for allowing visually impaired users to determine the amount toothpaste applied to the toothbrush.

Figure 6:
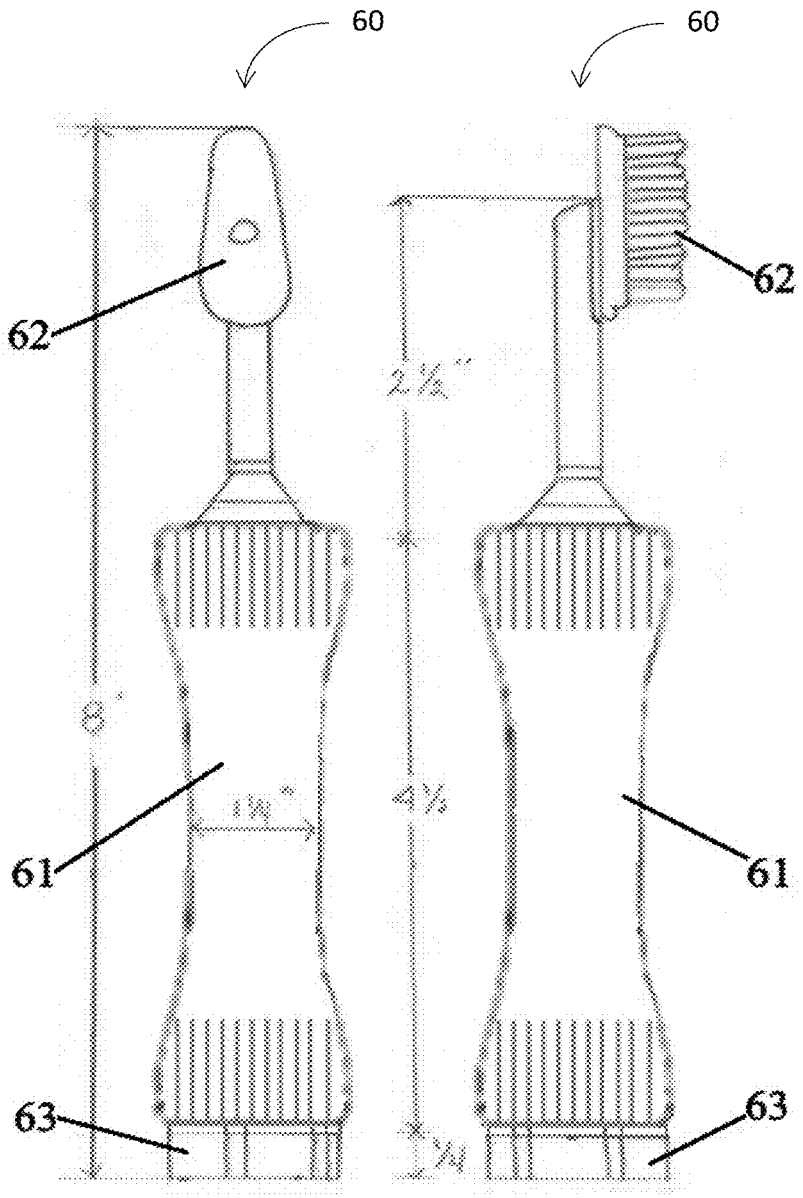
FIG. 6 is a diagram illustrating the components of the toothbrush of embodiments.

FIG. 6 illustrates generally at 60 a sketch of the toothbrush of various embodiments. The toothbrush 60 will generally include a handle portion 61 and the toothbrush portion 62. An end knob 63 is used to screw in and retain a turning plug configured push toothpaste from an integral hollow channel in the handle 61. For example, rotating the end knob 63 in a counterclockwise direction of rotation lowers a turning plug contained within the hollow handle 61 and a clockwise direction rotation raises the turning plug contained within the hollow handle 61, squeezing the toothpaste and feeding toothpaste into the hollow interior of toothbrush portion 72 and through the channel leading to the toothbrush bristle. The size of the hollow portion depicted can be of various sizes for clarity and may be much smaller, since it represents the reservoir of the toothpaste within the toothbrush portion 62.

Figure 7:
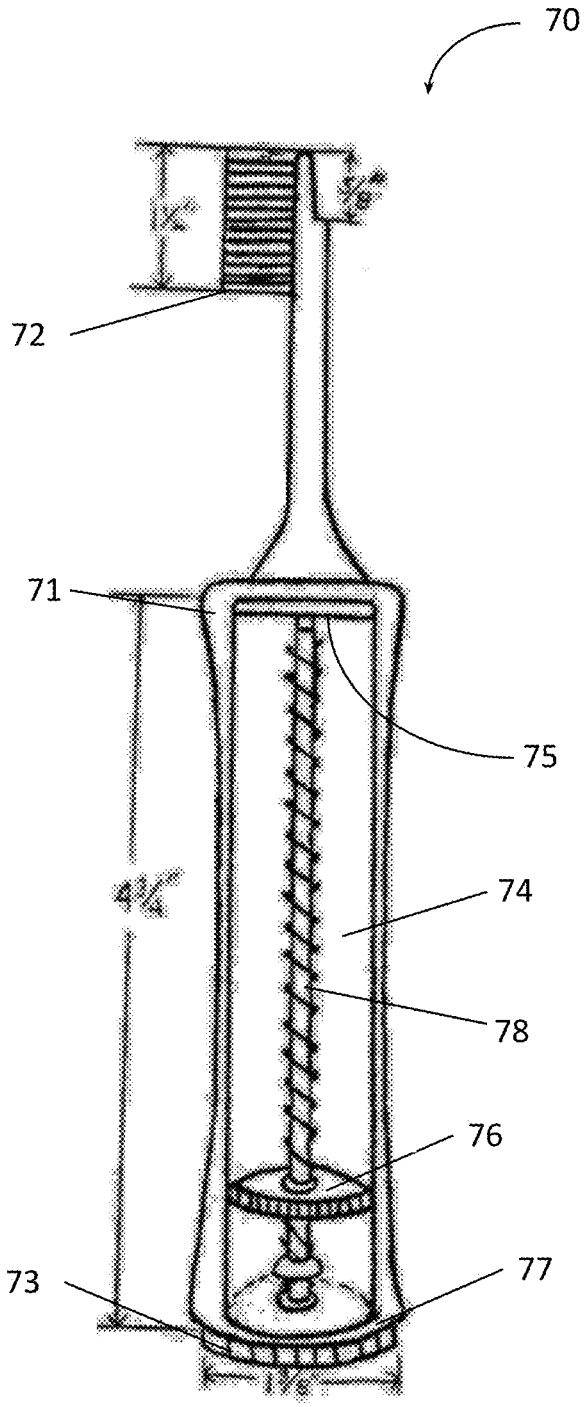
FIG. 7 is a diagram illustrating the internal components of the toothbrush.

FIG. 7 shows the details of an interior of the toothbrush 70 of some embodiments. The handle 71 contains reservoir 74 in which toothpaste is stored for dispensing onto the brush head 72. An orifice 75 is disposed on one end of the reservoir 74, and a movable plug 76 may be disposed on an opposite end of the reservoir 74. A bottom aperture 77 of the handle 71 may be configured to receive a rotatable end knob 73 that is fixedly attached to a screw post 78 that is associated with the movable 76 such that rotation of the rotatable knob 73 and, by extension, the screw post 78, causes the movable plug 76 to move within the reservoir 74, pushing the contents of the reservoir 76 toward the orifice 75 by reducing the volume of the reservoir 74. The screw post 78 may traverses the reservoir 74 at its center and may be rotatably attached to the handle 71 at the orifice 75. In some embodiments, the reservoir 76 may have one or more grooves (not shown) configured to receive tabs (not shown) on the movable plug 76 to limit rotation of the movable plug 76 within the reservoir. Thus, rotational force applied to the screw post 78 will be translated into vertical force for reducing the volume of the reservoir 76 and dispensing toothpaste from the reservoir. The bottom aperture 77 may include a sealing means such as an o-ring on its cylindrical periphery, which engages with the cylindrical portion at the top end of the handle 71 above the threaded portion, preventing escape of the toothpaste onto the handle 71 or motorized base.

Figure 8:
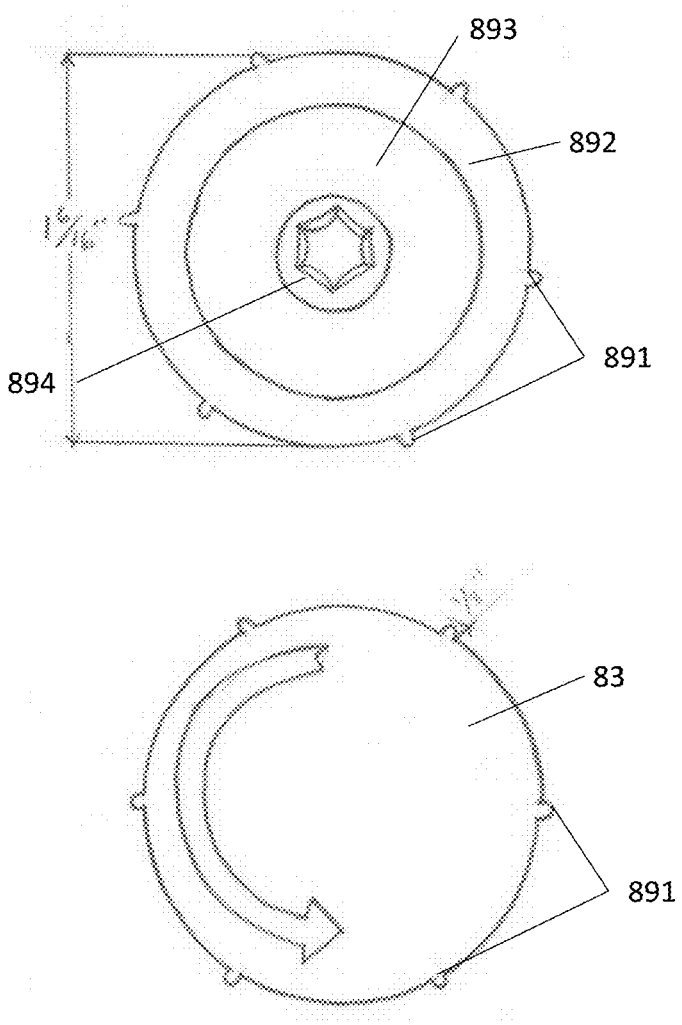
FIG. 8 is diagrams illustrating attachment and rotating means for engaging the toothbrush with the motorized base.

FIG. 8 shows examples of the rotatable end knob 83. In some embodiments as illustrated in FIG. 8B, the rotatable end knob 83 may be configured with laterally extending ridges 891 designed and configured to operably connect to slots in the motorized base (not shown), allowing the motorized base to rotate the rotatable end knob 83. The laterally extending ridges 891 may also provide a means for grasping and rotating the rotatable end knob 83. In some embodiments, the rotatable end knob 83 may have a two-part construction as illustrated in FIG. 8A. In such embodiments, an outer housing 892 may include laterally extending ridges 891 designed and configured to operably connect to slots in the motorized base (not shown). A rotatable insert 893 may be positioned within the outer housing 892 and may include an engagement means 894, such as a hexagonal socket, star-shaped socket, and the like, configured and designed to operably associate with the motorized base.

Figure 9:
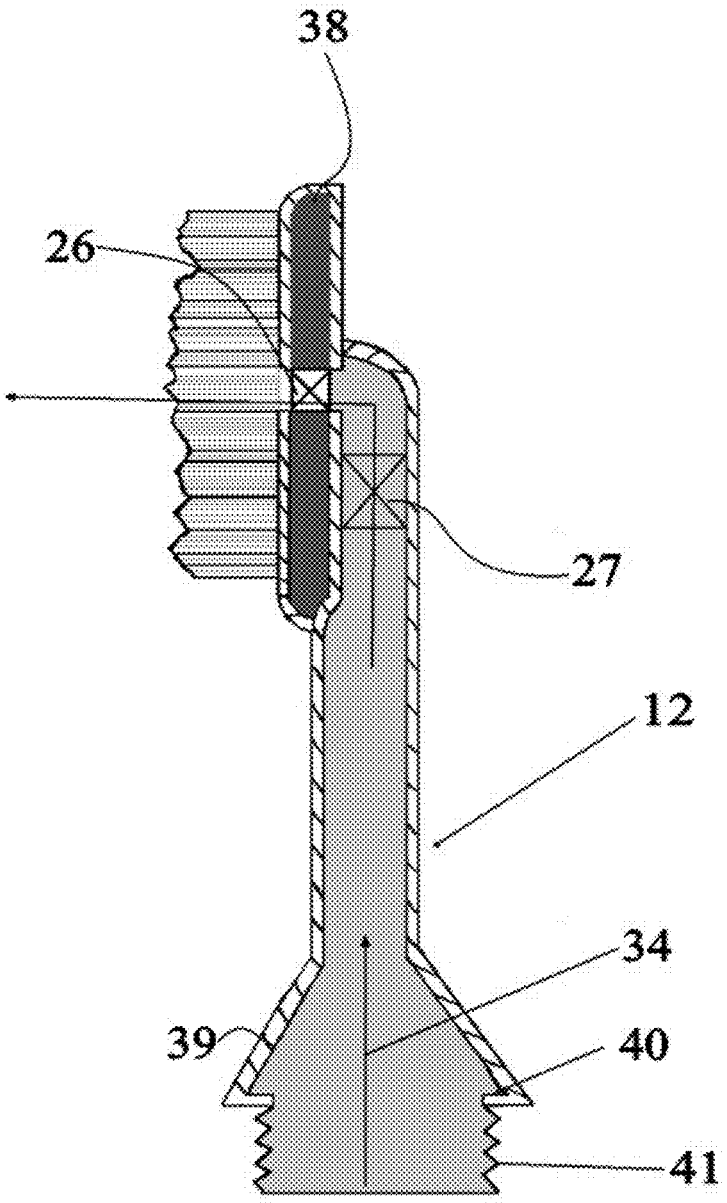
FIG. 9 is a diagram illustrating the components of a toothbrush head of embodiments.

FIG. 9 illustrates the details of the toothbrush head 12 as toothpaste is filled in within the interior cavity 34. The toothpaste enters the cavity 34 from the open end 39 of the toothbrush head as shown. The toothpaste passes through a non-return valve 27 and then into an opening 26, which releases the toothpaste to the bristles of the brush, as shown by the arrow. When the toothpaste is no longer pushed by the upward movement of the pedestal, the non-return valve is closed and no toothpaste can now spill. The small volume of toothpaste entrapped in the portion between the non-return valve and the opening 26 is easily dissolved and removed when the toothbrush is cleaned or rinsed after brushing. The plug 38, which may be a slide-fit plug or screwed-in plug may be removed to clean the interior passages of the toothbrush portion.

The toothbrush head 12 can be attached to the toothbrush handle 11 (see FIG. 1A, 1B) by any means, for example, a pressure fitting, latch, tab, or screw. As illustrated in FIG. 9, in certain embodiments, the toothbrush head 12 can be screwed onto the toothbrush handle (not shown) by grooves 41. This association may allow the cavity of the toothbrush handle to be continuous with the interior cavity 34 of the toothbrush head 12, allowing for complete evacuation of the toothpaste from the reservoir in the toothbrush handle. The grooves may terminate in a ridge 40 that provides a smooth transition between the toothbrush head 12 and the toothbrush body.

Figure 10:
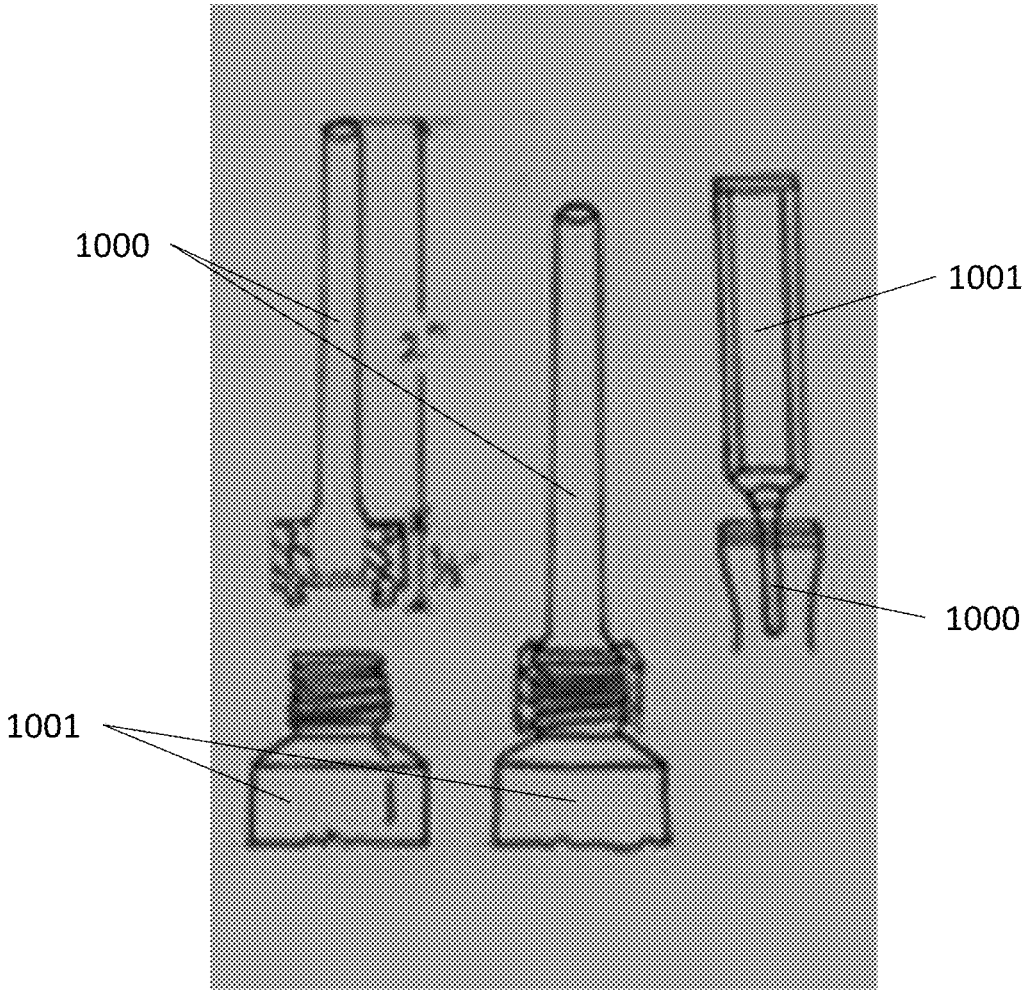
FIG. 10 is a diagram showing a toothpaste insertion head embodied by the invention.

Additional embodiments include a toothpaste insertion stem 1000 in FIG. 10. The toothpaste insertion stem 1000 may be configured to attach to a standard toothpaste container 1001 using a pressure fitting or screw fitting. In use, the toothpaste insertion stem 1000 extends the evacuation orifice of the toothpaste container 1001, allowing the toothbrush handle reservoir to be filled from the bottom up reducing loss of toothpaste and mess when filling the toothbrush handle reservoir.

Figure 11:
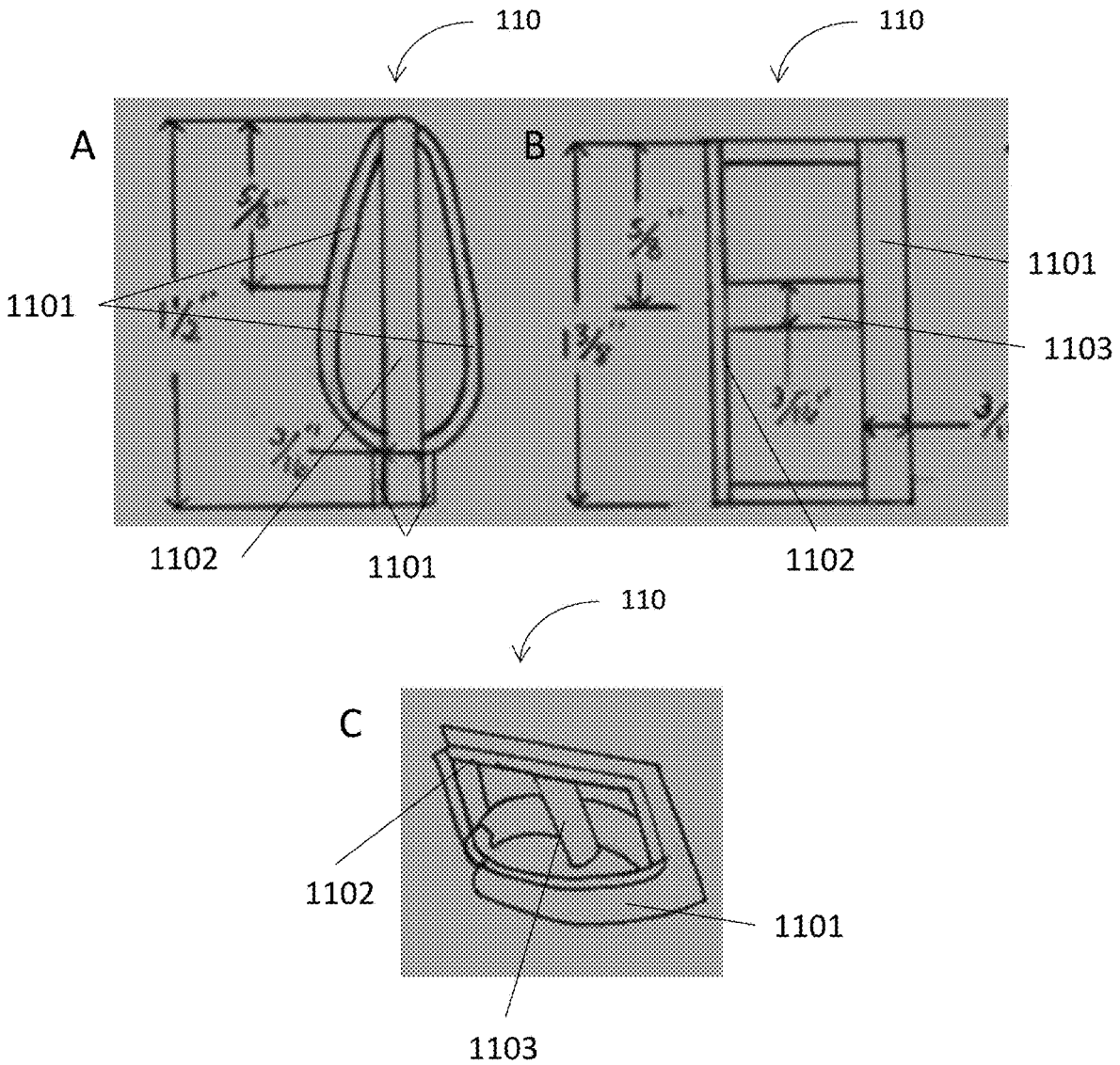
FIG. 11 is a diagram showing a toothbrush head cover embodied by the invention.

Further embodiments are directed to a toothbrush head cover 110 as illustrated in FIG. 11. The toothbrush head cover 110 may have side struts 1101 that are contoured to match the shape of a toothbrush head (not pictured) and attach to the sides of a toothbrush head to removably attached the toothbrush head cover 110 to the toothbrush head. In some embodiments, the removable attachment can be achieved by a pressure fitting created by the side struts 1101 pressing against the toothbrush head, and in other embodiments, the side struts may include, for example, tabs that embrace the toothbrush head and facilitate attachment. The toothbrush head cover 110 may further include a bridge 1102 attached to opposing ends of the side struts 1101 and arching over the bristles the toothbrush head when the toothbrush head cover 110 is attached to the toothbrush head. The bridge 1102 may attach to the side struts longitudinally across the longest section of the toothbrush head cover 110 (as pictured), cross-sectionally across a shorter section of the toothbrush head cover, or both longitudinally and cross-sectionally, and in some embodiments, the bridge may include one longitudinal arches and two or more cross-sectional arches creating a basket-like covering. In still other embodiments, the bridge 1102 may be a continuous solid covering extending from the side struts 1101 and completely covering the bristles of the toothbrush head when attached to the toothbrush head. The toothbrush head cover may further include a plug 1103 extending from the bridge 1102 toward the side struts and to a plane about parallel to the side struts. In use, the plug 1103 may cover and plug the opening (26 FIG. 9) in the toothbrush head when the toothbrush head cover is attached the toothbrush head.

The invention claimed is:

1. A system comprising a toothbrush and a motorized base, the motorized base comprising a lower stabilization housing, housing a motor or actuator operably coupled to an upper receiver housing configured to receive the toothbrush, the receiver housing having a receiver holder having an upper and lower surface and upward extending sides containing the series of ridges configured to associate with grooves on the toothbrush and cause a portion of the toothbrush to rotate when the motor or actuator is engaged, the receiver holder being in communication with a receiver base having a flat upper surface and a lower surface, the lower surface comprising an engagement pin that traverses the receiver holder through a hole through and a series of springs seated on the upper surface of the receiver holder, the engagement pin operably engages gearing operably attached to the motor or actuator attached to the lower side of the receiver holder such that the springs of the movable receiving base are compressed when the toothbrush is pressed into the upper receiver housing causing the engagement pin to engage the gearing and activating a motor or actuator causing the receiver holder to rotate, the motorized base having an audible measuring device that clicks or beeps as the receiver holder rotates.

2. The system of claim 1, wherein audible measuring device comprises a speaker or clicker, capable of producing sound at regular intervals when the movable receiving base is engaged against the receiver holder.

3. The system of claim 2, wherein a sound is produced for every ¼ turn of the receiver holder.

4. The system of claim 1, wherein the toothbrush comprising a toothbrush handle having upper drainage grooves on an upper surface of the toothbrush handle and lower drainage grooves on a lower surface of the toothbrush handle.

5. The system of claim 4, wherein the upper drainage grooves and the lower drainage grooves are composed of the same material as the toothbrush handle.

6. The system of claim 4, wherein the upper drainage grooves and lower drainage grooves may be composed of a different material than the toothbrush handle.

7. The system of claim 4, wherein the upper drainage grooves and lower drainage grooves are composed of a material having anti-bacterial properties or having an antibiotic dispersed within the material.

8. The system of claim 4, wherein the upper drainage grooves and lower drainage grooves are integral with the toothbrush handle.

9. The system of claim 4, wherein the upper drainage grooves and lower drainage grooves are a separate component from the toothbrush handle and are replaceable.

* * * * *